US005839366A

United States Patent [19]

Schaede

[11] Patent Number: 5,839,366

[45] Date of Patent: Nov. 24, 1998

[54] SHEET-FED PRINTING MACHINE

[75] Inventor: Johannes Georg Schaede, Wuerzburg, Germany

[73] Assignee: De La Rue Giori S.A., Switzerland

[21] Appl. No.: 727,950

[22] Filed: Oct. 9, 1996

[30] Foreign Application Priority Data

Oct. 20, 1995 [CH] Switzerland ..... 02993/95

[51] Int. Cl.[6] ..... B41F 13/24

[52] U.S. Cl. ..... 101/232; 101/231; 101/409; 101/246; 271/82

[58] Field of Search ..... 101/216, 228, 101/229, 230, 231, 232, 409, 118, 415.1; 271/209, 82, 85

[56] References Cited

U.S. PATENT DOCUMENTS

| | | | |
|---|---|---|---|
| 2,896,537 | 7/1959 | Kile et al. | 101/231 |
| 4,147,105 | 4/1979 | Becker | 101/230 |
| 4,660,825 | 4/1987 | Umezawa | 271/276 |
| 4,790,244 | 12/1988 | Otfried et al. | 101/231 |
| 4,852,488 | 8/1989 | Abendroth et al. | 101/246 |
| 4,856,426 | 8/1989 | Wirz | 101/217 |
| 4,882,988 | 11/1989 | Yamaguchi | 101/232 |
| 5,029,524 | 7/1991 | Wirz et al. | 101/232 |

FOREIGN PATENT DOCUMENTS

| | | |
|---|---|---|
| A0 161 531 | 11/1985 | European Pat. Off. . |
| A0 167 861 | 1/1986 | European Pat. Off. . |
| A19 17 795 | 11/1969 | Germany . |
| A22 52 231 | 5/1974 | Germany . |
| A37 10 341 | 11/1987 | Germany . |

OTHER PUBLICATIONS

Search Report listing cited references.

*Primary Examiner*—Christopher A. Bennett
*Attorney, Agent, or Firm*—Kane, Dalsimer, Sullivan, Kurucz, Levy, Eisele and Richard, LLP

[57] ABSTRACT

The impression cylinder (2), which together with the cylinder (1) that prints the image, forms the printing nip, co-operates with two transfer cylinders (3, 4) which feed or remove the sheets, and has an essentially closed cylindrical circumferential surface, into which, at the beginning of each impression segment, a suction strip (5, 6) is inset to apply suction to the front edge of a sheet. The two transfer cylinders (3, 4) are similarly provided with suction strips (7, 8; 13, 14) which are arranged in good register with the suction strips (5, 6) of the impression cylinder (2), and moreover have dipping grippers (10, 12; 16, 18), which are located in gaps in the dipping strips. Sheet transfer to and from the impression cylinder (2) is effected by alternately switching on and off the suction air at the relevant suction strips. As they pass the printing nip, the dipping grippers of the transfer cylinders occupy their lowered position, whilst away from the printing nip, they occupy their raised position, in order to hold the sheets while e suction air of the relevant suction strip is switched off.

8 Claims, 7 Drawing Sheets

FIG. 9
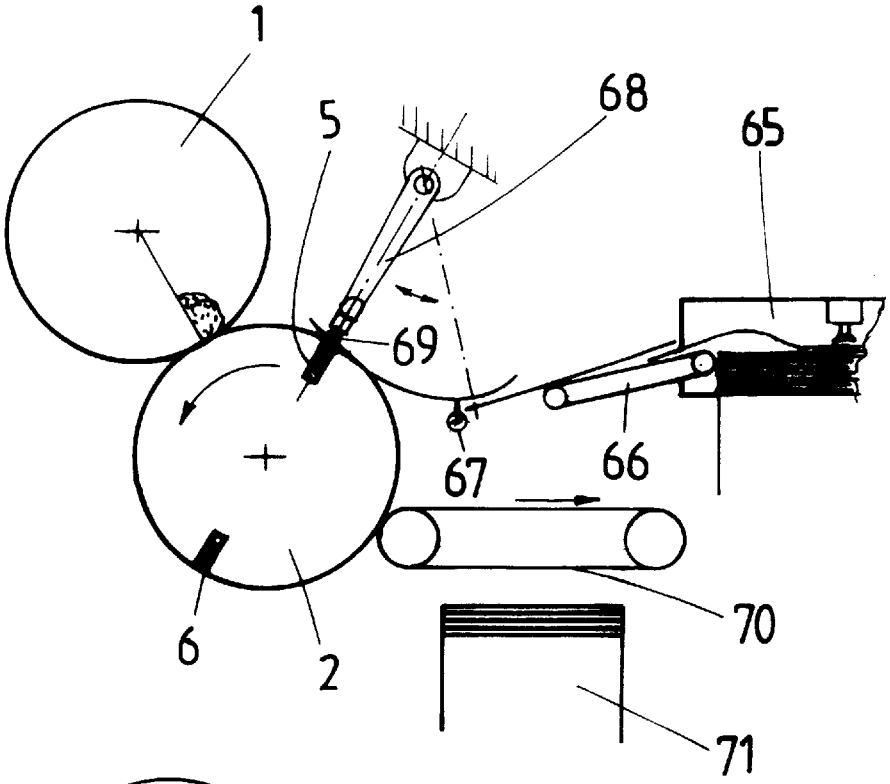
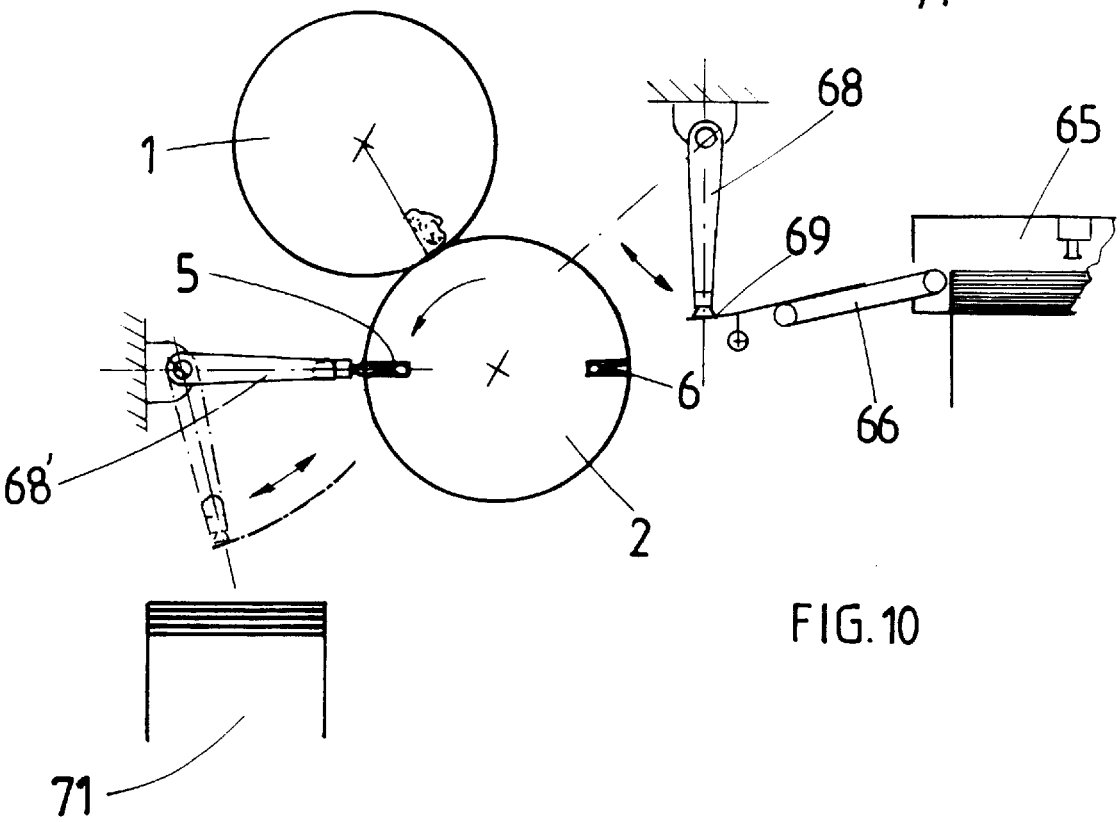
FIG. 10

SHEET-FED PRINTING MACHINE

FIELD OF THE INVENTION

The invention relates to a sheet-fed printing machine in accordance with the preamble of patent claim 1.

With sheet-fed printing machines of this type, known at present, the impression cylinder has printing saddles separated by cylinder pits, where the circumferential length of the printing saddles is adapted to the sheets being printed and the cylinder pits located between them are required to accommodate the sheet grippers.

PRIOR ART

This generally known design for an impression cylinder, the circumferential surface of which is interrupted by cylinder pits, leads to problems in various printing processes, particularly in screen printing, but also in relief printing. In the case of screen printing, there is the added disadvantage that the achievable printing speeds are lower than are required for economic reasons. Problems may also occur with offset printing; for example, particularly where the cylinders are slim, i.e. where the length is greater than the diameter, unwelcome vibration lines occur because of inadequate rigidity and as a result of the collision excitation caused by the printing saddles at the outset of pressure. Collision excitation can also cause trouble in intaglio printing.

SUMMARY OF THE INVENTION

The task of the present invention is to create an impression cylinder with a practically closed surface and with adapted transfer devices which enable transport of the sheets in a sheet-fed printing machine and which avoid the disadvantages which occur with impression cylinders with cylinder pits.

This task is solved by the characterising features of claim 1.

The result of this is that the impression cylinder, with its practically continuous, closed surface, continuously rolls against the cylinder printing the image, said cylinder being, in particular, a screen-printing cylinder in a screen-printing machine, a plate cylinder in an intaglio printing machine or a blanket cylinder in an offset printing machine for one-sided offset printing. The assembly and surface of the impression cylinder are adapted to the type of printing machine in each case.

In the case of a screen-printing machine, there is the added advantage, that no additional means have to be provided, to prevent the more or less flexible screen-printing stencil, which forms the outer circumference of the screen-printing cylinder, from being forced into a cylinder pit in the impression cylinder during printing by the internal, close-lying doctor blade, and from being damaged. Even in the case of a so-called gapless sheet-fed offset printing machine, in other words where the plate cylinder and blanket cylinder have continuously closed circumferential surfaces, an impression cylinder according to the invention, with closed circumferential surface, is very advantageous because it effectively prevents collision excitations and/or changes in the printing pressure between the blanket cylinder and the impression cylinder.

Practical embodiments of the invention, with various versions of the means of transfer which are used to transfer sheets to and from the impression cylinder, are quoted in claims 2 to 5; further practical developments are shown in the other dependent claims 6 to 10.

BRIEF DESCRIPTION OF THE DRAWINGS

The invention is explained in greater detail by embodiments, with the help of the drawings.

FIG. 9 shows a fourth embodiment of a screen-printing machine of simplified design, without transfer cylinder, FIG. 10 shows a fifth, likewise simplified embodiment of a screen printing machine

DESCRIPTION OF THE PREFERRED EMBODIMENTS

Figure 1:
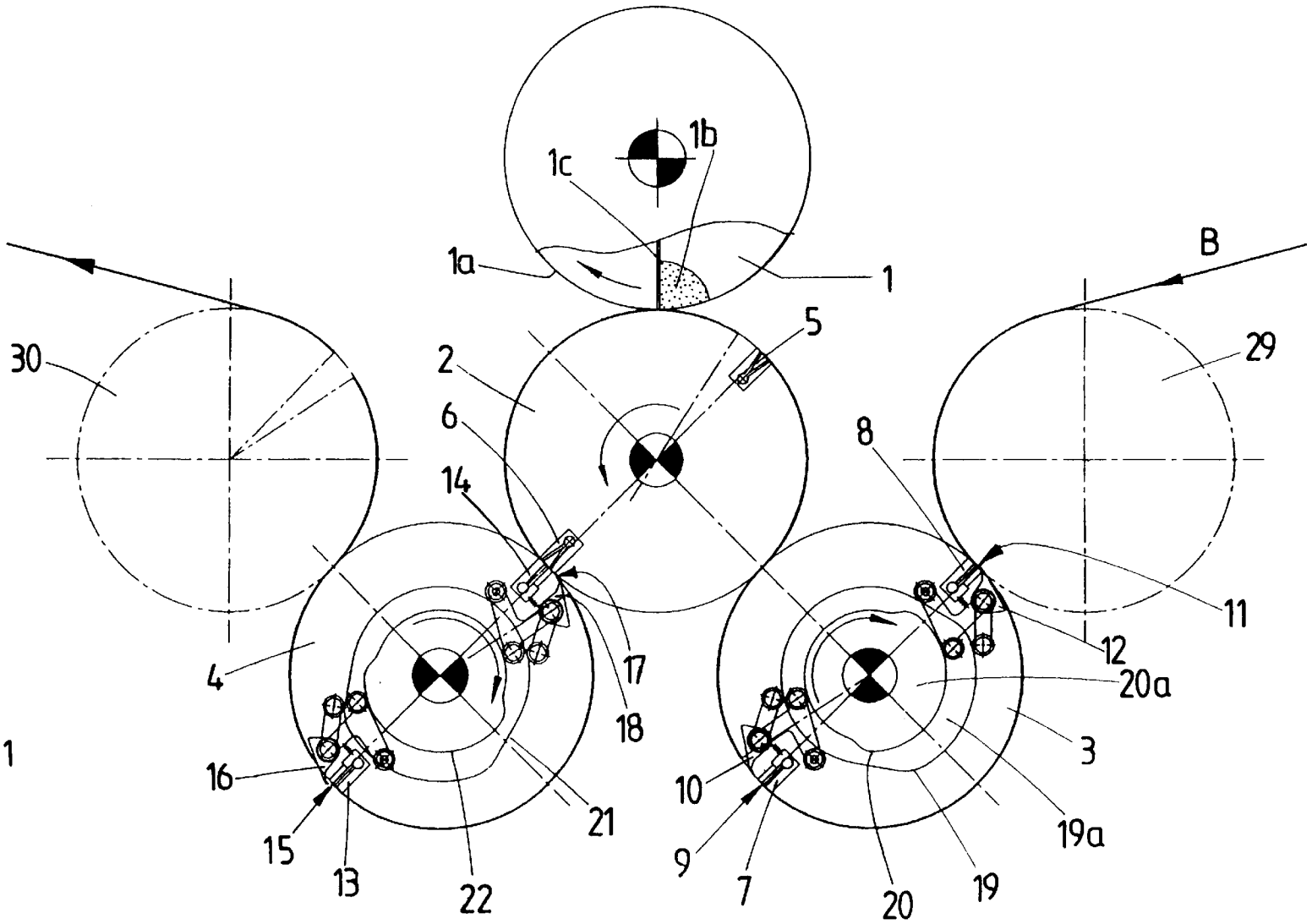
FIG. 1 shows the schematic drawing of a first embodiment of a screen-printing machine according to the invention.

The sheet-fed printing machine according to FIG. 1 has a screen-printing cylinder 1, the circumference of which is formed by a cylindrical screen printing stencil 1*a*, and inside said screen-printing cylinder, the build-up of ink accumulated by a doctor blade 1*c* is indicated, as well as an impression cylinder 2 which co-operates with this screen-printing cylinder 1, where both cylinders 1, 2 form the printing nip between each other, through which the sheets B are fed through for printing by impression cylinder 2 in the direction of the arrow.

Impression cylinder 2 co-operates with two transfer cylinders 3 and 4, from which cylinder 3, acting as a delivery or hand-over cylinder, transports the sheets supplied by a further transfer cylinder 29 to the impression cylinder 2, and the transfer cylinder 4, acting as a take-over cylinder, accepts the printed sheets from impression cylinder 2 and passes them on to a further transfer cylinder 30 for onward transport. In the example considered, all the cylinders are of the same size and are dimensioned in such a way that there is space for two sheets along their circumference. The directions of rotation of all the cylinders are indicated by arrows. The area occupied by one sheet on the circumference of a cylinder is designated as the impression segment of this cylinder; the cylinders therefore have two impression segments each corresponding to half of the cylinder circumference.

The impression cylinder 2 consists essentially of a closed cylindrical surface. At the beginning of each impression segment, seen in the direction of rotation of the cylinder, a suction strip 5 or 6 is inserted in the impression cylinder 2 parallel to the cylinder axle, said suction strip having suction apertures which opens out onto the cylinder circumference and is connected to a vacuum source. These suction strips 5, 6 which have a continuous, gapless surface, hold the sheet on the impression cylinder between the sheet take-up and the sheet hand-over, particularly during the printing process, and are made from a rigid material, in order to obtain a correct register when printing.

The two transfer cylinders 3 and 4 which co-operate with the impression cylinder 2 are specially designed, because with the conventional transfer cylinders fitted with grippers, the grippers could not open because of the closed surface of the impression cylinder 2. Therefore, the two transfer cylinders 3 and 4 are each fitted with combinations of suction strips and dipping gripper devices. The transfer cylinder 3 has two suction strips 7 and 8 positioned opposite one another, of which suction strip 7 is situated close to one dipping gripper arrangement 9 with the dipping grippers 10, and the other suction strip 8 is situated close to a dipping gripper arrangement 11, with the dipping grippers 12. The other transfer cylinder 4 also has two opposite suction strips 13 and 14 of which the suction strip 13 is situated close to a dipping gripper arrangement 15 with the dipping gripper 16 and the other suction strip 14 is situated close to the dipping gripper arrangement 17 with the dipping grippers 18.

Figure 4:
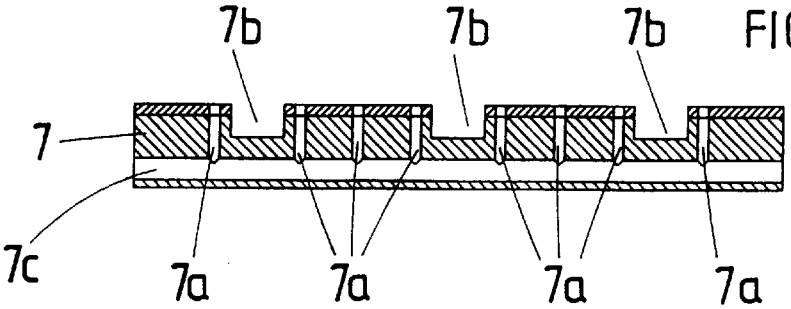
FIG. 4 shows a section through a suction strip in the transfer cylinder, running parallel to the axle of the latter.

The suction strips 7, 8, 13, 14 lie in good register with the suction strips 5, 6 of the impression cylinder, i.e. at the beginning of a sheet supporting surface of the transfer cylinders 3, 4 and are designed to be flexible in a radial direction, so that in each case, a rigid suction strip 5 or 6 of the impression cylinder 2 co-operates with a flexible suction strip 7, 8, 13 or 14 of the transfer cylinders 3 or 4. The dipping grippers are located in gaps in the suction strips, as illustrated in FIG. 4 for suction strip 7 which is provided with suction apertures 7*a* and gaps 7*b*. The gaps 7*b* are sufficiently deep for the dipping grippers 10 to be completely submerged. The suction apertures 7*a* branch off from a common suction channel 7*c*, which can be connected to a vacuum source.

The opening and closing of the dipping grippers 10 and 12 of the transfer cylinder 3 are controlled by a disc cam 19 permanently located on the axle of this cylinder and, with regard to their dipping movement, are controlled by a further cam disc 20 permanently located on the cylinder axle. In the same way, the dipping grippers 16 and 18 of the transfer cylinder 4 are controlled by the two disc cams 21 and 22. All dipping gripper arrangements are designed in the same way and are described in greater detail in FIG. 3, which shows an enlargement of transfer cylinder 3.

According to this figure, the dipping grippers 10 of the dipping gripper arrangement 9 fitted to the outer end of a lever arm 24, are pivoted on a common gripper shaft 23, which is supported at one end of an elbow lever 26. At the other end of the lever arm 24, a cam roll 25 is installed, which when the cylinder 3 is rotated, rolls against the disc cam 19 which represents the radial cam for opening and closing the dipping grippers 10 and 12 and is shaped accordingly. As long as the cam roll 25 is located on the area 19*a* of the disc cam 19, said area 19*a* being extended radially outwards, the dipping grippers occupy their closing position, otherwise, they occupy their opening position. These two gripper positions are changed by slightly slewing around the gripper shaft, i.e. in the case of gripper arrangement 9 with the dipping grippers 10, around gripper shaft 23.

The elbow lever 26 is pivoted at its other, internal end around a fixed axle 27 situated in cylinder 3 and has, at its centre, i.e. its angle edge, a cam roll 28 which is pivoted, and which rolls against the other disc cam 20, which forms a guide curve for the dipping movement of the dipping grippers and is shaped accordingly. So long as the cam roll 28 rolls against the area 20*a* of the disc cam 20, said area 20*a* being extended radially outwards, the dipping grippers occupy their raised position; otherwise they adopt their lowered position. The two positions are changed by slewing around the fixed axle at the internal end of the elbow lever, i.e. in the case of the dipping gripper arrangement 9, by slewing the elbow lever 26 around the axle 27, and the non-fixed gripper shaft 23 with the dipping grippers 10 is essentially displaced in a radial direction.

Figure 3:
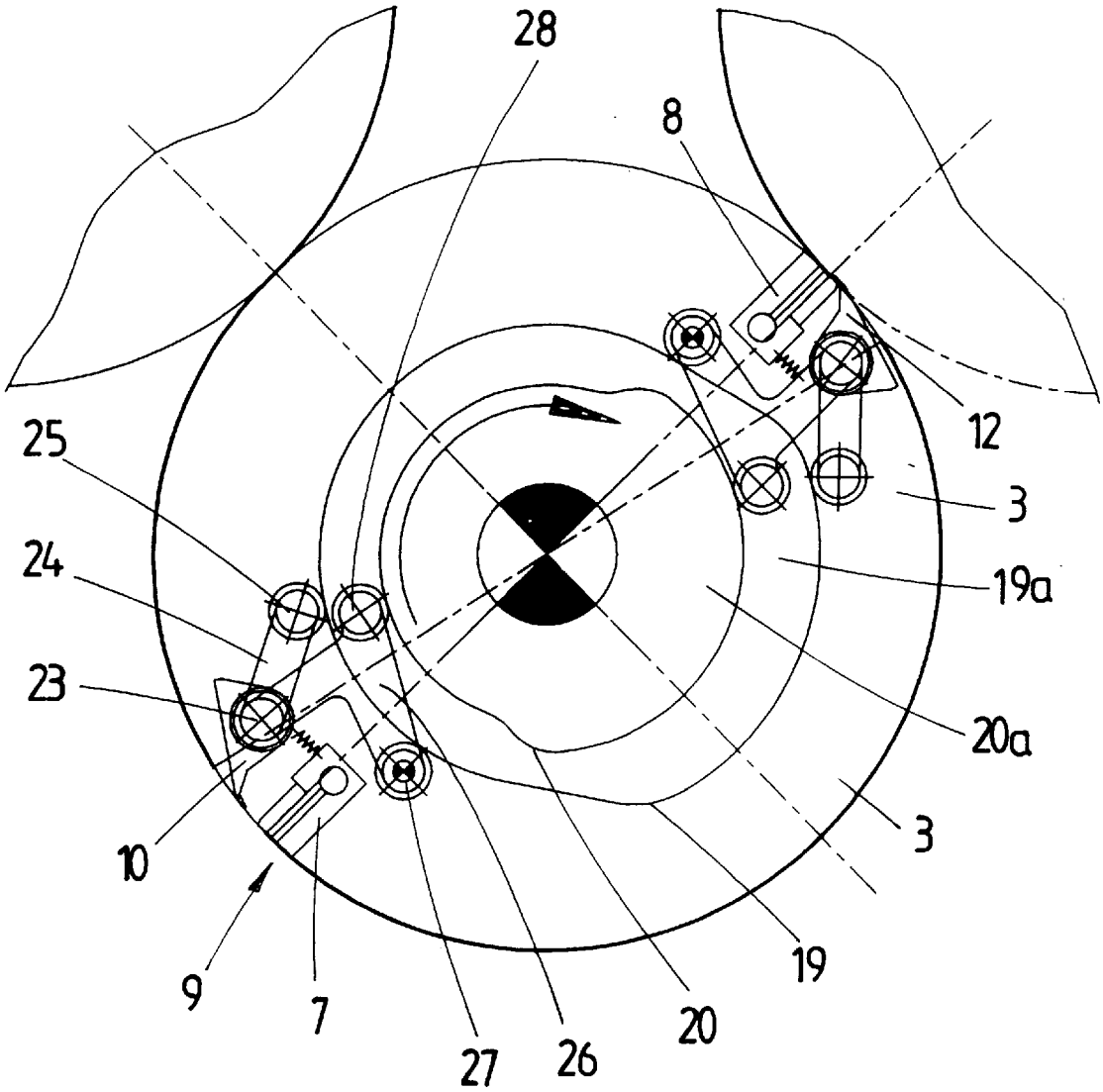
FIG. 3 shows an enlargement of a transfer cylinder according to FIGS. 1 and 2.

In the illustration according to FIG. 3, the gripper 10 occupies its opening position and is located in the lowered position, whilst the gripper 12 occupies its closing position and is located in the raised position.

The device described operates as follows:

The transfer cylinder 3 which acts as a delivery cylinder, accepts a sheet from the normally designed transfer cylinder 29 (FIG. 1), whereby the dipping grippers 12 which are in their raised position, take hold of the front edge of the sheet and are moved to their closing position, which they have just occupied according to FIG. 1. If the transfer cylinder 3 is rotated further, the flexible suction elements of the suction strip 8 arranged between the dipping grippers, are connected via a corresponding suction air control, to the suction air source and thus apply suction to the sheet. The dipping grippers 12 then open (FIG. 2) so that the sheet is now only held to the suction strip 8 by suction. The grippers 12 are then lowered into their dipping position, in which they are located below the circumferential surface of the transfer cylinder 3, as illustrated in FIG. 1, for the grippers 10.

As soon as the front edge of a sheet reaches the impression cylinder 2, it is taken over by the appropriate suction strip of this impression cylinder. In the illustration according to FIG. 2, the sheet which is still being held by the suction strip 7, is handed over to the suction strip 6 of the impression cylinder 2, by cutting off the suction air at the suction strip 7 and switching on the suction air at suction strip 6. As the suction strips of the transfer cylinders are flexible in a radial direction, minor fluctuations in the thickness of the paper and differences in curvature can be compensated for when the sheet is transferred.

The sheet taken over by the suction strip 6 of impression cylinder 2 is guided through the printing nip, is printed there and then passed on to the transfer cylinder 4 which acts as the take-over cylinder (FIG. 1), by applying suction air to the suction strip 14 of the transfer cylinder 4 and by switching off the suction air at the suction strip 6 of the impression cylinder 2. At the moment the sheet is handed over, the dipping grippers 18 are in their lowered and opened position. If the transfer cylinder 4 is further rotated, these dipping grippers 18 are raised (FIG. 2) and moved into their closing position, so that they now hold the sheet; the suction air at the suction strip 14 is then switched off. When the front edge of the sheet reaches the transfer cylinder 30, the sheet is handed over in the usual way by the dipping grippers of the transfer cylinder 4, to the grippers of the transfer cylinder 30.

The taking and handing over of a sheet between the impression cylinder 2 and the transfer cylinder 3 or 4, occurs in each case, as a result of the reciprocal switching on and off of the suction air at the relevant suction strips of the cylinders, whilst the dipping grippers of the transfer cylinders occupy their lowered dipping position. Once a sheet has been handed over to the impression cylinder, the dipping grippers 10 or 12 of the transfer cylinder 3 are moved into the raised position to take over a sheet, before reaching the transfer cylinder 29 again, whilst the dipping grippers 16 or 18 of the other transfer cylinder 4, having handed over a sheet to the transfer cylinder 30, are moved from their raised to their lowered position, before they reach the impression cylinder 2 again.

Figure 2:
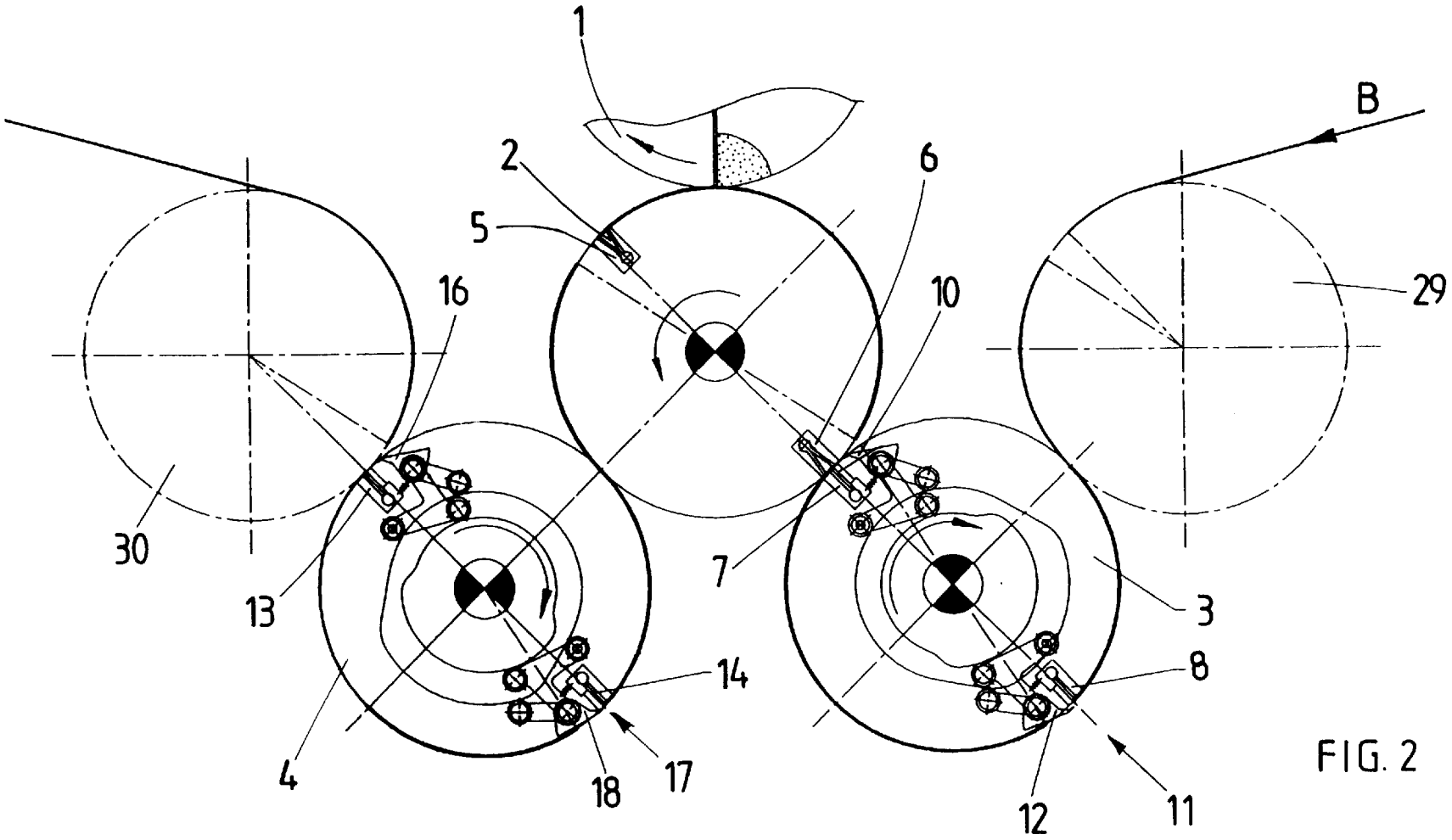
FIG. 2 shows the same machine in a different operating position, in which the cylinders have been rotated by approximately 90° in the direction of the arrow, relative to the position shown in FIG. 1.

The cylinders each transport two sheets simultaneously; e.g. according to FIG. 2, one sheet is printed whilst the subsequent sheet is just being handed over to the impression cylinder 2.

Figure 5:
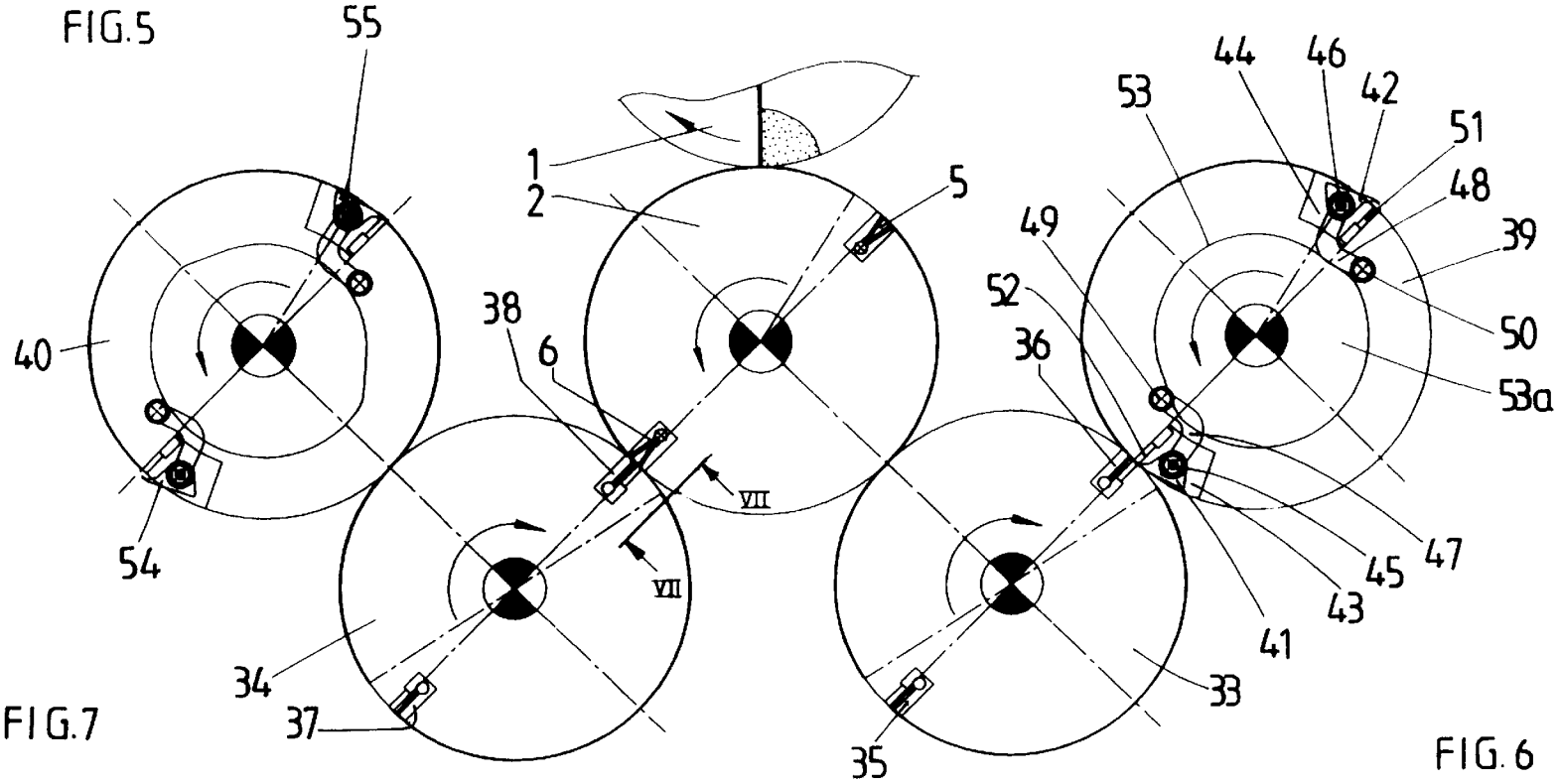
FIG. 5 shows a second embodiment of a screen printing machine according to the invention.

In the example according to FIG. 5, the screen-printing machine again has a screen-printing cylinder 1, an impression cylinder 2 which co-operates with the latter, two transfer cylinders 33 and 34 which co-operate with the impression cylinder 2, said transfer cylinders acting as delivery and take-over cylinders respectively, and a further transfer cylinder 39 which transfers the sheets to the transfer cylinder 33 and a further transfer cylinder 40, which accepts the sheets from the transfer cylinder 34. Again, all the cylinders are the same size and are dimensioned in such a way that there is space for two sheets around their circumference. The impression cylinder 2 is designed exactly like the impression cylinder 2 of the first embodiment according to FIGS. 1 to 3, and it again has two diametrically opposed suction strips 5 and 6 made from rigid material.

In contrast to the first embodiment, the two transfer cylinders 33 and 34 which co-operate with the impression cylinder 2, are only fitted with two slightly flexible suction strips 35, 36 or 37, 38 each, i.e. they have no grippers. Sheet transfer from the transfer cylinder 33 to the impression cylinder 2 and from the latter to the transfer cylinder 34, takes place, as with the first embodiment, by reciprocal switching on and off of the suction air at the relevant suction strips, as the latter pass each other, with the result that the front edge of the sheet is sucked on to the suction strip of the cylinder to which transfer is being made and can, at the same time, become detached from the suction strip of the handing-over cylinder.

The transfer cylinders 39 and 40 are fitted with normal sheet grippers which, when they co-operate with transfer cylinder 33 or 34, receive the front edge of the sheet in question by closing, whilst at the same time, the suction air at the relevant suction strip of the transfer cylinder 33 or 34 is switched off.

The transfer cylinder 39 is provided with cylinder pits 43 and 44, to accommodate its sheet grippers 41 and 42. The grippers 41 and 42 are located at the end of an elbow lever 47 or 48, which can be pivoted around an axle 45 or 46 located in the cylinder pit 43 or 44. At the internal end of the elbow lever 47 or 48, is located a cam roll 49 or 50, which rolls against a disc cam 53 permanently mounted on the cylinder axle, said disc cam forming a guide cam. As long as a cam roll rolls over the area 53*a* of the cam roll 53, said area 53*a* being extended radially outwards, the grippers in question occupy their opening position, as illustrated for the grippers 42, whilst in the other case, the grippers are held in their closing position, as illustrated, for the grippers 41. The other transfer cylinder 40, with its grippers 54, 55, is designed in exactly the same way as the transfer cylinder 39 described above. A supporting strip 51 or 52 for the sheets, provided on the inside of the grippers 41 or 42, said supporting strip being integrated into the gripper supporting strip, ensures that the hand-over of the sheets to the transfer cylinder 33 or from transfer cylinder 34, takes place correctly.

Figure 6:
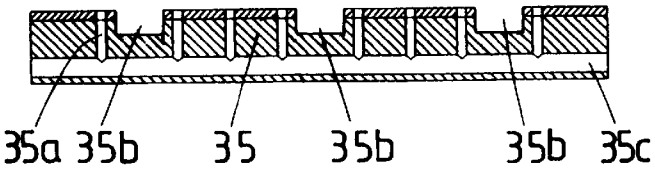
FIG. 6 shows a section through a suction strip in one of the transfer cylinders shown in FIG. 5, and parallel to its axle.

So that the grippers 41 or 42—which are opening at this moment—of the transfer cylinder 39 can pass the transfer cylinder 33 unhindered, when a sheet is being handed over from transfer cylinder 39 to transfer cylinder 33, the suction strips 35 and 36 of the transfer cylinder 33 are provided with corresponding gaps, as shown in FIG. 6 for the suction strip 35 with its gaps 35*b*, which make it possible for the open grippers of the transfer cylinder 39 to plunge downwards. The suction apertures 35*a* are in turn connected to a common suction channel 35*c*.

The suction strips 37 and 38 of the transfer cylinder 34 are designed in the same way, so that the open grippers 54, 55 of the transfer cylinder 40, can pass the transfer cylinder 34 unhindered.

In the printing machine according to FIG. 5, for example, a sheet which is held by the closed grippers on the transfer cylinder 39, is conveyed to the transfer cylinder 33 by connecting the appropriate suction strip of this transfer cylinder to the compressed air source and simultaneously opening the appropriate sheet grippers of the transfer cylinder 39. The sheet is transported on transfer cylinder 33 to impression cylinder 2 by suction and is transferred to the latter by connecting the appropriate suction strip of the impression cylinder 2 to the vacuum source and simultaneously switching off the suction air of the relevant suction strip of the transfer cylinder 33. The sheet is then conveyed on the impression cylinder 2, past the screen printing cylinder 1 and then handed over to the other transfer cylinder 34 by switching the suction air on and off as appropriate; from here, the sheet passes to the transfer cylinder 40, the grippers of which are closed for this purpose when passing the transfer cylinder 34.

Figure 7:
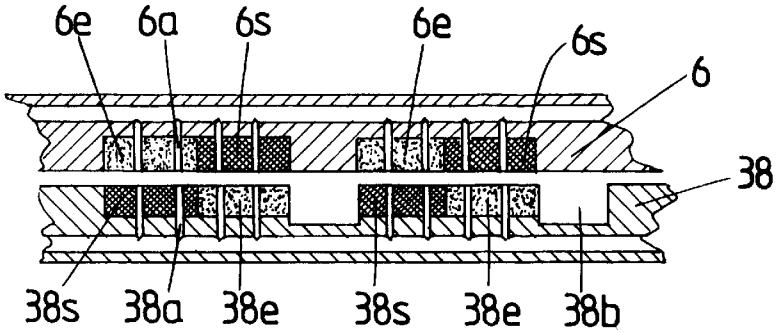
FIG. 7 shows a different embodiment of the suction strips of the impression cylinder and a transfer cylinder, in cross-section, parallel to the cylinder axles (in accordance with VII—VII according to FIG. 5), where the two suction strips which co-operate during sheet transfer, are shown a small distance apart.

FIG. 7 illustrates another preferred embodiment of the suction strips of the impression cylinder 2 and the transfer cylinder 33 and 34, here in the case of the gapless suction strip 6 of the impression cylinder 2, which co-operates during sheet transfer with the suction strip 38 of the transfer cylinder 34. The two strips are illustrated in section, parallel to the cylinder axles and, in order to gain a clearer picture, are shown a small distance apart.

The suction strip 6 is provided with an arrangement of material sections, which each enclose a number of suction apertures 6*a* and consist of adjacent areas made from flexible material 6*e* and rigid material 6*s*. In a similar way, material sections are provided in the suction strip 38, having gaps 38*b*, of the transfer cylinder, said material sections also enclosing several suction apertures 38*a* and consisting of adjacent areas made from flexible material 38*e* and rigid material 38*s*. The arrangement is such, that during sheet transfer, an area of flexible material of the one suction strip always co-operates reciprocally with an area of rigid material of the other suction strip. In this way, sheet transfer in good register is guaranteed and at the same time ensures that minor fluctuations in paper thickness are compensated for.

Figure 8:
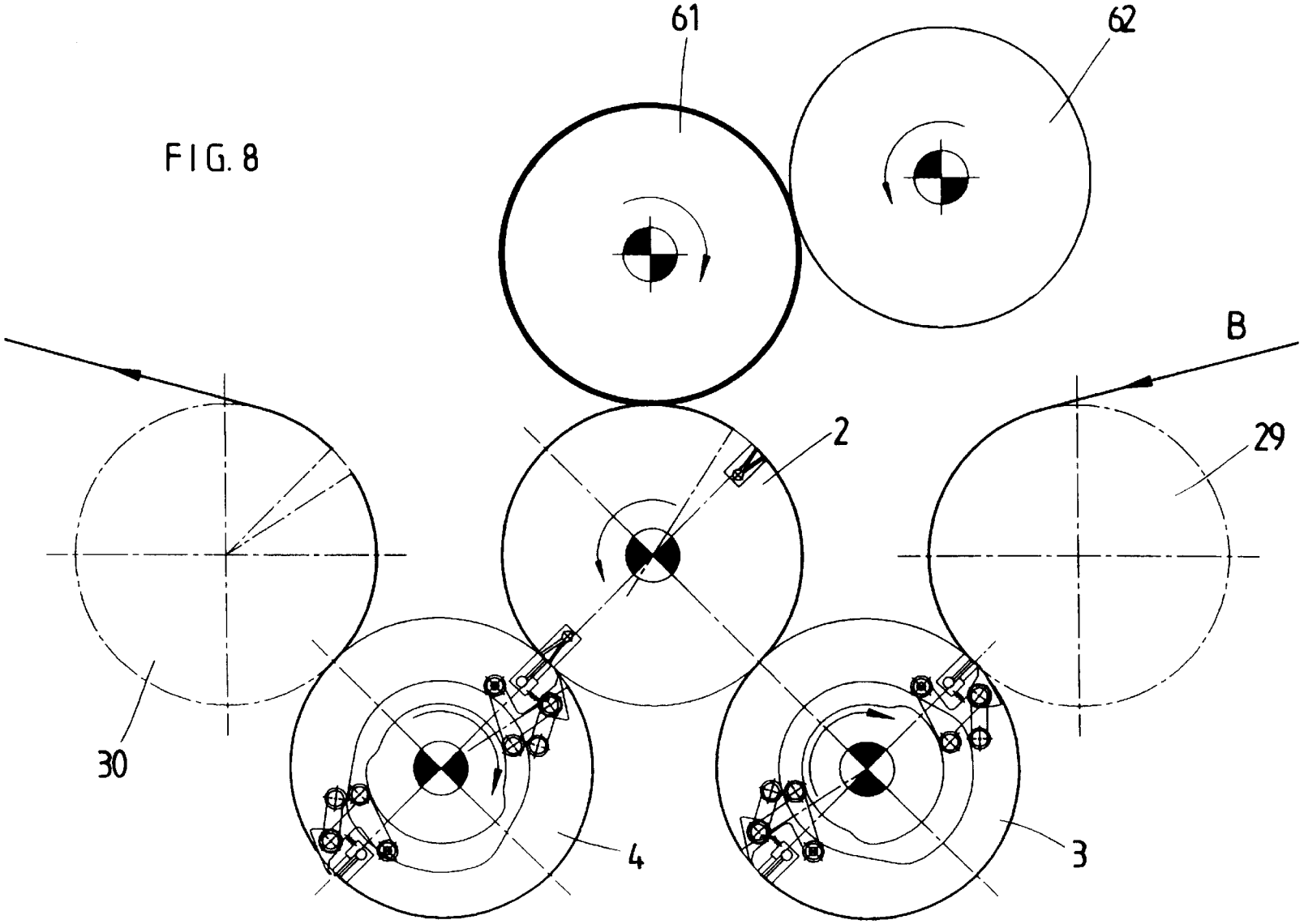
FIG. 8 shows a schematic representation of a third embodiment, i.e. of an offset printing machine.

FIG. 8 illustrates in schematic form an offset printing machine according to the invention, which has a plate cylinder 62, a blanket cylinder 61 of the same size, which has been inked by this plate cylinder, an impression cylinder 2, two transfer cylinders 3 and 4 and two further transfer cylinders 29 and 30. The design and arrangement of the impression cylinder 2 and of the transfer cylinders 3, 4, 29 and 30 are the same as described in the embodiment according to FIGS. 1 to 3. In the example considered, the plate cylinder 62 carries a seamless plate sleeve with two offset print designs and the blanket cylinder 61 is provided with a seamless rubber blanket sleeve. In other words, we are dealing with a so-called "gapless" offset printing machine where the impression cylinder 2 with closed circumferential surface, is particularly advantageous, since any change in printing pressure between blanket cylinder 61 and the impression cylinder 2 is prevented. In other words, the cylinder printing the image in this case, is the blanket cylinder 61, by which a sheet on the impression cylinder 2 is printed on one side.

FIG. 9 shows a simplified embodiment of a screen printing machine according to the invention, having a screen printing cylinder 1 and an impression cylinder 2, which has suction strips 5 and 6, as described previously, and, dispensing with transfer cylinders, co-operates directly with gripperless devices to transfer an incoming, unprinted sheet and to receive and pass on a printed sheet.

In the example considered, the unprinted sheets are individually guided by a known sheet feeder 65 via a suction belt bench 66, to a known front lay device 67, at the front lay of which the sheet is aligned longitudinally and laterally in a state of rest in a known manner. The sheet transfer device proper consists of a sheet swing device with suckers, i.e. a swing gripper 68, which has at one end a suction strip 69 and swings to and fro in the direction of the double arrow.

Once the swing gripper 68 reaches its right end position as indicated by the dot-dash line in FIG. 9, the front edge of the sheet is then sucked onto the suction strip 69 which is then connected to a vacuum source, whilst the swing gripper is temporarily at rest; once the front lay has been lowered in the known way, in order to release the sheet, the swing gripper swings to the left into the hand-over position on the impression cylinder 2, as shown in FIG. 9, said impression cylinder 2 rotating in the direction of the curved arrow. The swing gripper 68 is accelerated to the speed of the machine and the sheet is handed over in phase to the suction strip 5 of the impression cylinder 2 which is then passing the hand-over point, by switching off the suction air at the suction strip 69 of the swing gripper 68 and switching on the suction air at the suction strip 5 of the impression cylinder 2.

The suction strip 69 of the swing gripper 68 is preferably constructed in the same way as the suction strip 38 shown in FIG. 7, but without gaps, and the suction strips 5 and 6 of the impression cylinder 2 like the suction strip 6 shown in FIG. 7, arranged as a mirror-image of the material areas. When the suction strip 69 of the swing gripper 68 co-operates with a suction strip 5 or 6 of the impression cylinder 2, a rigid material section of the one suction strip then co-operates with a flexible material section of the other suction strip, as described in FIG. 7.

Instead of a suction belt bench 66 with a suction belt, another known conveyor belt or other known sheet conveying device can also be provided to transport the sheets from the sheet feeder 65 to the front lay device 67.

In the example according to FIG. 9, the sheet take-over device consists of a suction belt device 70, which works for example, with two parallel suction belts and which, in each case, lie along a third of the sheet width. When the front edge of the printed sheet, which is printed when it passes the printing nip and which lies against the suction strip 5 or 6, reaches the suction belts, the suction air at the suction strip 5 or 6 is switched off, the front edge of the sheet is sucked against the suction belts and then the sheet is, so to speak, peeled away from the impression cylinder 2 and conveyed on by the suction belts. The suction air of the suction belt device 70 is controlled in such a way that the sheet is conveyed in a stretched state on the underside of the suction belts over a delivery stack 71 and is then allowed to fall onto the stack by switching off the suction air, whereupon it is aligned using conventional joggers.

In the example according to FIG. 9, the suction belt device 70 is located on the same side of the impression cylinder 2 as the swing gripper 68, so that the sheets, which are removed from the impression cylinder 2, reach in an advantageous way the top side of the suction belts. In principle, however, the suction belt device 70 in the example according to FIG. 9 can also be fitted to the left side of the impression cylinder 2, the circumferential speed of which is directed downwards, so that the sheets removed from the impression cylinder 2 directly reach the underside of the suction belts, where they are held by suction.

FIG. 10 shows a further simplified embodiment of a screen printing machine, having a screen printing cylinder 1 and an impression cylinder 2 which in turn has two suction strips 5 and 6, as described above. This printing machine also operates without transfer cylinders and has a sheet transfer device which operates directly with the impression cylinder 2, said sheet transfer device being in the form of a swing gripper 68, having a suction strip 69, the swing gripper being so precisely designed and working in exactly the same way as described in the example according to FIG. 9. As with this example, the sheets are fed by a sheet feeder 65 via a suction belt bench 66 to a front lay device 67, where the individual sheets are taken up by the swing gripper 68.

The sheet receiving device in this case also consists of a swing gripper 68' which is installed on the side of the impression cylinder 2 opposite the swing gripper 68, and also has at its end, a suction strip 69', which is effectively constructed in exactly the same way as the suction strip 69. In the take-over position of the swing gripper 68', illustrated in FIG. 10 by full lines, the suction strip 5 of the impression cylinder 2 which holds the printed sheet, passes this hand-over point and the front edge of this sheet is then sucked against the suction strip 69' which is then connected to the vacuum source, and at the same time, the suction air at the suction strip 6 of the impression cylinder 2 is switched off. The sheet is taken over whilst the swing gripper 68' is making its swinging movement. The upper end position of said swing gripper 68' according to FIG. 10 is situated above the take-over point and when it passes this take-over point, has a. speed corresponding to the circumferential speed of the impression cylinder 2. When the swing gripper 68' swings down, the sheet is pulled away from the impression cylinder 2, as indicated by the dot-dash, and guided directly over the delivery stack 71, where it is dropped by switching off the suction air.

In an embodiment not illustrated, the sheet hand-over device consists of a suction belt which places the incoming sheets tangentially against the suction strip of the impression cylinder, as it passes the sheet hand-over point, so that the front edge of the sheet is sucked against the suction strip which is then connected to the vacuum source and is pulled onto the impression cylinder. In the example according to FIG. 9, therefore, the suction belt device 70 could also perform the function of handing over the sheet by feeding the sheets individually to the underside of the suction belts, where they are held by suction and passed on to the impression cylinder 2 at the transfer point. In this case, of course, the swing gripper 68 above the suction belts would not be required.

Generally speaking, swing grippers or suction belt devices, in the form of gripperless devices, can also be provided as sheet hand-over and/or sheet take-over devices.

If the sheets being printed are not too large and are sufficiently stiff, then an endless belt or an endless chain can be provided as the sheet hand-over device, said endless belt or chain having push fingers which rest against the rear edge of the sheet and push the sheets forward until their front edge is grasped by a suction strip of the impression cylinder.

Figure 11:
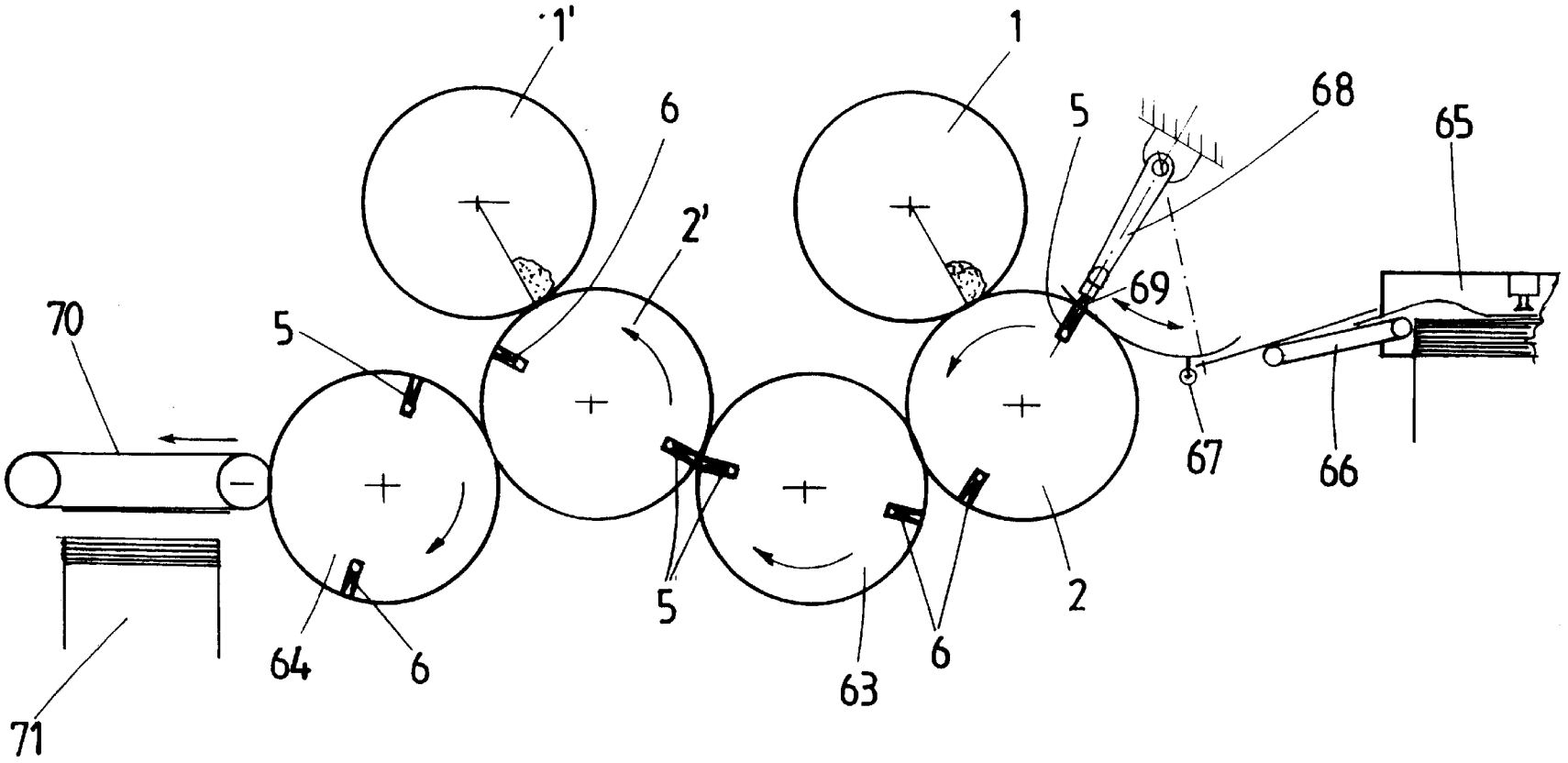
FIG. 11 shows a sixth embodiment of a two-colour, screen printing machine according to the invention.

FIG. 11 shows a further embodiment, namely a two-colour screen printing machine, which has a first pair of cylinders, consisting of a screen printing cylinder 1 and impression cylinder 2 as well as a second pair consisting of a screen printing cylinder 1' and impression cylinder 2'. The impression cylinders 2 and 2' are designed in exactly the same way as the impression cylinders 2 in the embodiments described above, and they are provided with gapless suction strips 5 and 6, which are preferably developed in the same way as the suction strip 6 shown in FIG. 7. A transfer cylinder 63 is provided between the impression cylinders 2 and 2' and to receive a sheet from the impression cylinder 2', a transfer cylinder 64 is provided, which co-operates with the latter. Both transfer cylinders 63 and 64 in this case are also provided with gapless suction strips 5, 6, which are designed in exactly the same way as the suction strips of the impression cylinders 2 and 2'. If these suction strips preferably have alternately rigid and flexible material sections, as shown in FIG. 7 for suction strip 6, then the arrangement must be such that when a suction strip of an impression cylinder co-operates with the suction strip of a transfer cylinder, a rigid material section of the one suction strip co-operates with a flexible material section of the other suction strip in each case, as described in FIG. 7. The direction of rotation of all the cylinders is indicated by arrows.

The sheets are transferred to the impression cylinder 2 in exactly the same way as in the example according to FIG. 9, i.e. using a swing gripper 68, the suction strip 69 of which takes up a sheet at the front lay 67, to which this sheet has been fed by a sheet feeder 65 via a suction belt bench 66. The sheet handed over to the impression cylinder 2 receives a first print image as it passes the first screen printing cylinder 1, and then passes from impression cylinder 2 by appropriately reversing the suction air at the relevant suction strips, to the transfer cylinder 63, and from here to the second impression cylinder 2', where it is given a second print image as it passes the second screen printing cylinder 1' and is then transferred from the impression cylinder 2' to the transfer cylinder 64 by adjusting the suction air accordingly. This last transfer cylinder 64 co-operates with a suction belt device 70 with parallel, endless suction belts acting as take-over device, as described in the example according to FIG. 9, whereby the sheets reach the delivery stack 71. In other words, with this printing machine, the sheets are transferred by a simple method, purely with the help of gapless suction strips, the suction air supply to which is alternately controlled to transfer a sheet from one cylinder to the other.

The invention is not limited to the printing machines described, but also allows many different variants with regard to the dimensions of the cylinders, the number of sheets to be accommodated around the cylinder circumference, i.e. of the impression segments, and hence the number of suction strips or gripper arrangements of the cylinders and finally also of the design of the suction strips and gripper arrangements as necessary. Similarly, gripperless devices which co-operate with a closed transfer cylinder or directly with the impression cylinder, can also be provided, as mentioned, which transfer a sheet to the continuous circumferential surface of the first cylinder or remove a sheet from the continuous circumferential surface of the last cylinder.

I claim:

1. Sheet-fed printing machine for feeding sheets having a front edge comprising at least one pair of cylinders including an impression cylinder (2) and a cylinder (1) printing the image, where both cylinders (1,2) form the printing nip between them and have at least one impression segment, characterised in that the impression cylinder (2) has an essentially closed cylindrical circumferential surface, into which a suction strip (5,6) is inset at the beginning of each impression segment, said suction strip (5,6) for connecting to a suction air source to apply suction to the front edge of a sheet and to hold the same during conveying on the impression cylinder and during the printing process, and being disconnectable from the suction air source in order to release the sheet form the impression cylinder, and that means of transfer are provided adjacent to the impression cylinder before the printing nip for delivering a sheet to the impression cylinder (2) as well as behind the printing nip to take over a sheet from the impression cylinder, the means of transfer having at least one transfer cylinder (63,64) co-operating with the impression cylinder (2), said transfer cylinder being provided with gapless suction strips that are the same as the gapless section strips of the impression cylinder (2), in such a way that sheet transfer between these cylinders is exclusively effected by reciprocal control of the suction air supply to the co-operating suction strips, and that the transfer of a sheet to the impression cylinder (2) or to its transfer cylinder or of a sheet form the transfer cylinder (64) or from the impression cylinder is effected by a gripperless device comprising a sheet swing device (68) with suckers or a suction belt device (70).

2. Sheet-fed printing machine according to claim 1 characterised in that in the case of a multi-colour sheet-fed printing machine having several pairs of cylinders comprising an impression cylinder (2, 2') and a cylinder (1, 1') which prints the image, a transfer cylinder (63) with suction strips (5, 6) is located between impression cylinders (2, 2') of adjacent pairs of cylinders.

3. Sheet-fed printing machine according to claim 1, characterised in that the means of transfer comprise two transfer cylinders (3, 4; 33, 34) adjacent to the impression cylinder (2) on both sides of the printing nip, one cylinder being a sheet delivery cylinder (3; 33) and the other cylinder being a sheet take-over cylinder (4, 34).

4. Sheet-fed printing machine for feeding sheets having a front edge comprising at least one pair of cylinders including an impression cylinder (2) and a cylinder (1) printing the image, where both cylinders (1,2) form the printing nip between them and have at least one impression segment, characterised in that the impression cylinder (2) has an essentially closed cylindrical circumferential surface, into which a suction strip (5,6) is inset at the beginning of each impression segment, said suction strip (5,6) for connecting to a suction air source to apply suction to the front edge of a sheet and to hold the same during conveying on the impression cylinder and during the printing process, and being disconnectable from the suction air source in order to release the sheet from the impression cylinder, and that means of transfer are provided adjacent to the impression cylinder before the printing nip for delivering a sheet to the impression cylinder (2) as well as behind the printing nip to take over a sheet from the impression cylinder, the means of transfer have at least one transfer cylinder (3,4) adjacent to the impression cylinder (2), said transfer cylinder being provided at the beginning of each sheet supporting surface with a suction strip (7,8; 13,14), which is arranged in good register with the relevant suction strip (5,6) of the impression cylinder (2), and is moreover provided with adjustable dipping grippers (10, 12; 16, 18) which are located in gaps (7*b*) in the suction strip, and that the switching on and off of the suction air at the suction strips and the adjustment of the dipping grippers can be controlled in such a way that when they pass the impression cylinder (2), the dipping grippers (10, 12; 16, 18) adopt their lowered position below the circumferential surface of the transfer cylinder (3,4), that in this lowered position of the dipping grippers, a sheet is held on the transfer cylinder (3, 4) by the latter's suction strip (7, 8; 13, 14) which is connected to a suction air source, that transfer to or from the impression cylinder (2) is effected by the suction strips of transfer cylinder and impression cylinder, which are alternately connected to the suction air source, and the dipping grippers (10, 12; 16, 18) occupy their raised working position to grasp or release a sheet.

5. Sheet-fed printing machine according to claim 4, characterised in that each transfer cylinder (3,4) is provided with two fixed radial cams (19,20) for closing and opening the dipping grippers (10,12) and for adjusting the same between a raised and lowered position.

6. Sheet-fed printing machine for feeding sheets having a front edge comprising at least one pair of cylinders including an impression cylinder (2) and a cylinder (1) printing the image, where both cylinders (1,2) form the printing nip between them and have at least one impression segment, characterised in that the impression cylinder (2) has an essentially closed cylindrical circumferential surface, into which a suction strip (5,6) is inset at the beginning of each impression segment, said suction strip (5,6) for connecting to a suction air source to apply suction to the front edge of a sheet and to hold the same during conveying on the impression cylinder and during the printing process, and being disconnectable from the suction air source in order to release the sheet from the impression cylinder, and that means of transfer are provided adjacent to the impression cylinder before the printing nip for delivering a sheet to the impression cylinder (2) as well as behind the printing nip to take over a sheet from the impression cylinder, the means of transfer have at least one transfer cylinder (33, 34) adjacent to the impression cylinder (2), said transfer cylinder being provided at the beginning of each sheet supporting surface with a suction strip (35, 36; 37, 38) which is arranged in good register with the relevant suction strip (5, 6) of the impression cylinder (2), and has gaps (35*b*) and that the transfer cylinder (33, 34) co-operates with a further transfer cylinder (39, 40), which at the beginning of each sheet support surface has sheet grippers (41, 42; 54, 55) located in a cylinder pit (43, 44), said sheet grippers when co-operating with the transfer cylinder (33, 34) first mentioned, engaging in said gaps (35*b*) of the suction strip (35, 36 or 37), 38) and releasing or gripping the sheet, where the sheet is transferred on the transfer cylinder and the impression cylinder and where delivering or taking-over of the sheet to or from the impression cylinder (2) is effected exclusively by the suction strips which are alternately connected to a suction air source.

7. Sheet-fed printing machine according to claim 4, characterised in that the suction strips (5,6) of the impression cylinder are made from rigid material, whilst the suction strips (7,8; 13,14) of the transfer cylinders (3,4) are flexible in a radial direction.

8. Sheet-fed printing machine according to claim 1 or 6, characterised in that the suction strips (6, 38) of the impression cylinder (2) and of a transfer cylinder (34), which co-operate during sheet transfer, comprises an arrangement of alternately rigid material of the one suction strip always co-operates with an area of flexible material of the other suction strip.

* * * * *